US011419460B2

(12) United States Patent
Shyka

(10) Patent No.: US 11,419,460 B2
(45) Date of Patent: Aug. 23, 2022

(54) BATHING CHAIR ASSEMBLY

(71) Applicant: Joseph Shyka, Keller, TX (US)

(72) Inventor: Joseph Shyka, Keller, TX (US)

( * ) Notice: Subject to any disclaimer, the term of this patent is extended or adjusted under 35 U.S.C. 154(b) by 406 days.

(21) Appl. No.: 16/689,179

(22) Filed: Nov. 20, 2019

(65) Prior Publication Data

US 2021/0145218 A1 May 20, 2021

(51) Int. Cl.

| | |
|---|---|
| ***A47K 3/12*** | (2006.01) |
| ***A61H 33/00*** | (2006.01) |
| ***A47C 7/62*** | (2006.01) |

(52) U.S. Cl.

CPC ..... *A47K 3/122* (2013.01); *A47C 7/626* (2018.08); *A61H 33/6021* (2013.01); *A61H 2201/0149* (2013.01); *A61H 2201/164* (2013.01); *A61H 2201/1623* (2013.01); *A61H 2201/1635* (2013.01)

(58) Field of Classification Search

CPC ..... A47K 3/122; A47K 3/282

See application file for complete search history.

(56) References Cited

U.S. PATENT DOCUMENTS

| | | | | |
|---|---|---|---|---|
| 3,040,335 | A * | 6/1962 | Gellmann | A47K 3/122 4/570 |
| 4,150,445 | A | 4/1979 | Bailey | |
| 6,195,814 | B1 * | 3/2001 | Yoshida | A47K 3/282 4/601 |
| 6,817,045 | B1 | 11/2004 | Fainberg | |
| D660,042 | S | 5/2012 | Higgs | |
| 8,185,982 | B1 * | 5/2012 | Lizama | A47K 3/28 4/615 |
| 9,345,365 | B1 | 5/2016 | Welles | |
| 2004/0060107 | A1 * | 4/2004 | Eisenberg | A47K 7/046 4/605 |
| 2006/0260041 | A1 * | 11/2006 | Paz | A61H 7/004 4/573.1 |
| 2012/0233766 | A1 * | 9/2012 | Homan | A61H 33/025 4/573.1 |
| 2016/0206108 | A1 * | 7/2016 | Müller | A47K 3/125 |
| 2019/0159633 | A1 * | 5/2019 | Lee | A47K 3/122 |
| 2019/0183293 | A1 * | 6/2019 | Day | A47K 3/122 |

* cited by examiner

*Primary Examiner* — J C Jacyna

(57) ABSTRACT

A bathing chair assembly includes a chair that is positionable in a shower for a user to sit thereon. The chair is foraminous to pass water therethrough for bathing. A hose is fluidly coupled to the chair and the hose is fluid attachable to a shower head in the shower for receiving water therefrom. In this way the chair sprays the water for bathing the user when the user is sitting in the chair. A pump is coupled to the chair to increase the pressure of the water being sprayed outwardly from the chair. A reservoir is coupled to the chair and the reservoir contains a fluid soap. The reservoir releases the fluid soap into the chair to release a mixture of the fluid soap and the water for bathing.

12 Claims, 6 Drawing Sheets

BATHING CHAIR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bathing devices and more particularly pertains to a new bathing device for bathing a seated user in a shower.

(2) Description of Related Art Including Information Disclosed Under 37 CFR 1.97 and 1.98

The prior art relates to bathing devices.

BRIEF SUMMARY OF THE INVENTION

An embodiment of the disclosure meets the needs presented above by generally comprising a chair that is positionable in a shower for a user to sit thereon. The chair is foraminous to pass water therethrough for bathing. A hose is fluidly coupled to the chair and the hose is fluid attachable to a shower head in the shower for receiving water therefrom. In this way the chair sprays the water for bathing the user when the user is sitting in the chair. A pump is coupled to the chair to increase the pressure of the water being sprayed outwardly from the chair. A reservoir is coupled to the chair and the reservoir contains a fluid soap. The reservoir releases the fluid soap into the chair to release a mixture of the fluid soap and the water for bathing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
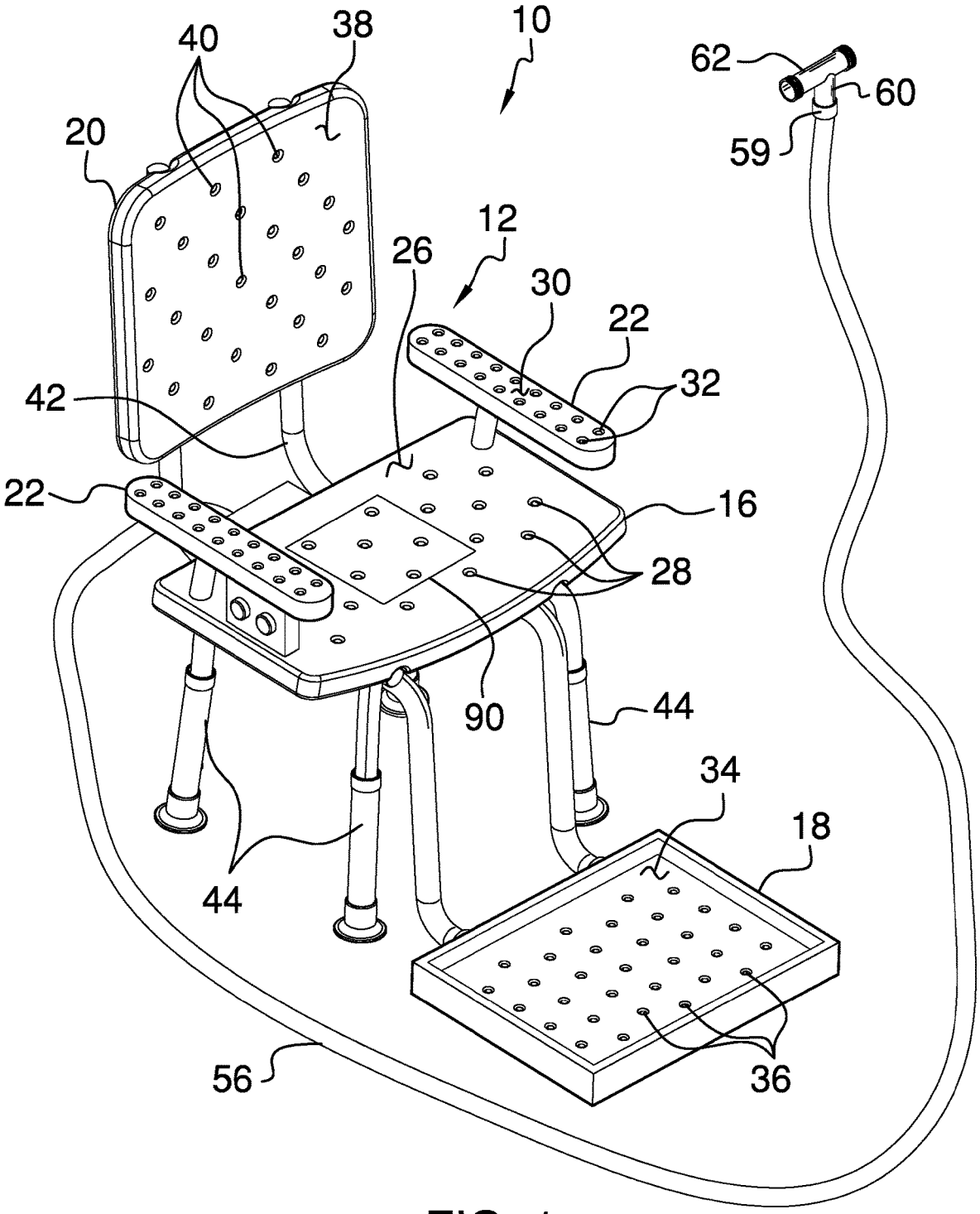
FIG. 1 is a perspective view of a bathing chair assembly according to an embodiment of the disclosure.
Figure 2:
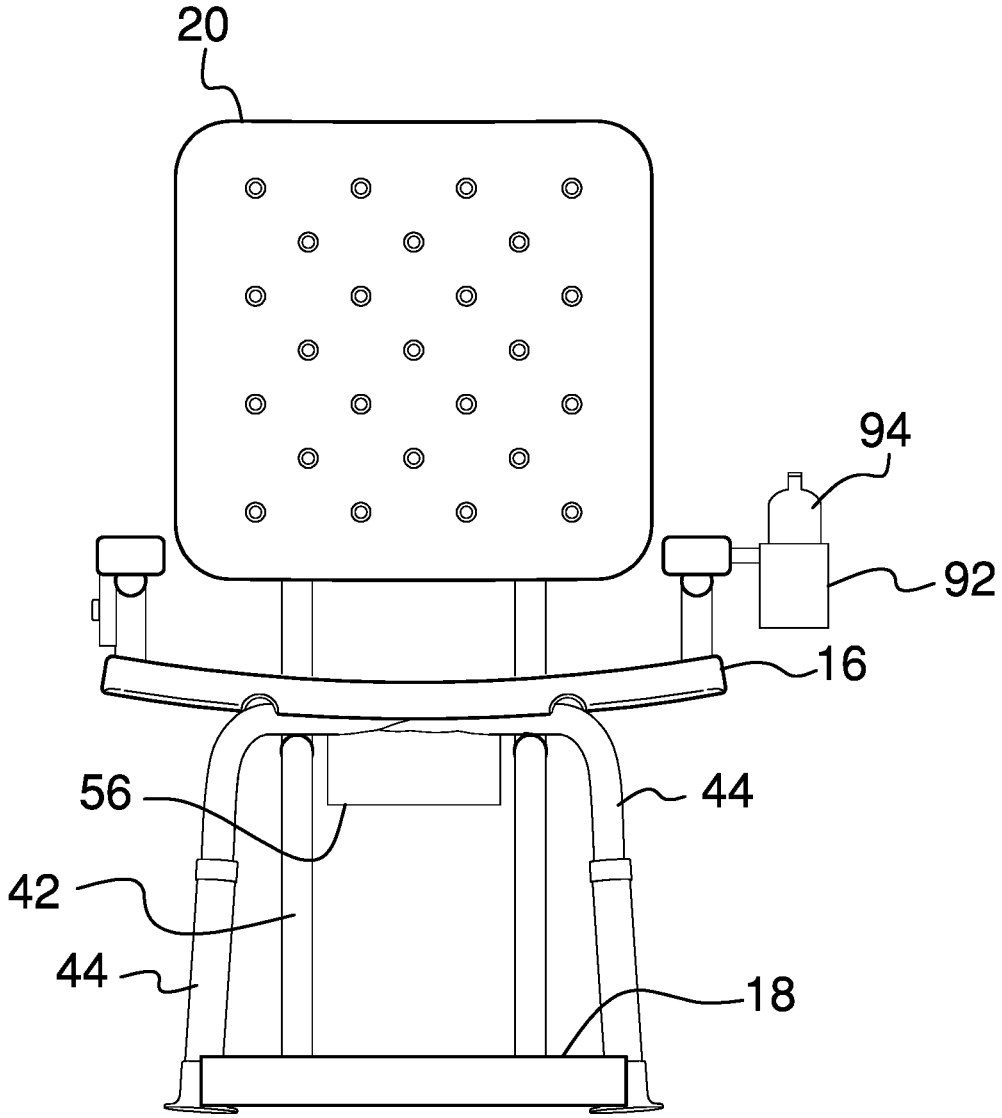
FIG. 2 is a front view of an embodiment of the disclosure.
Figure 3:
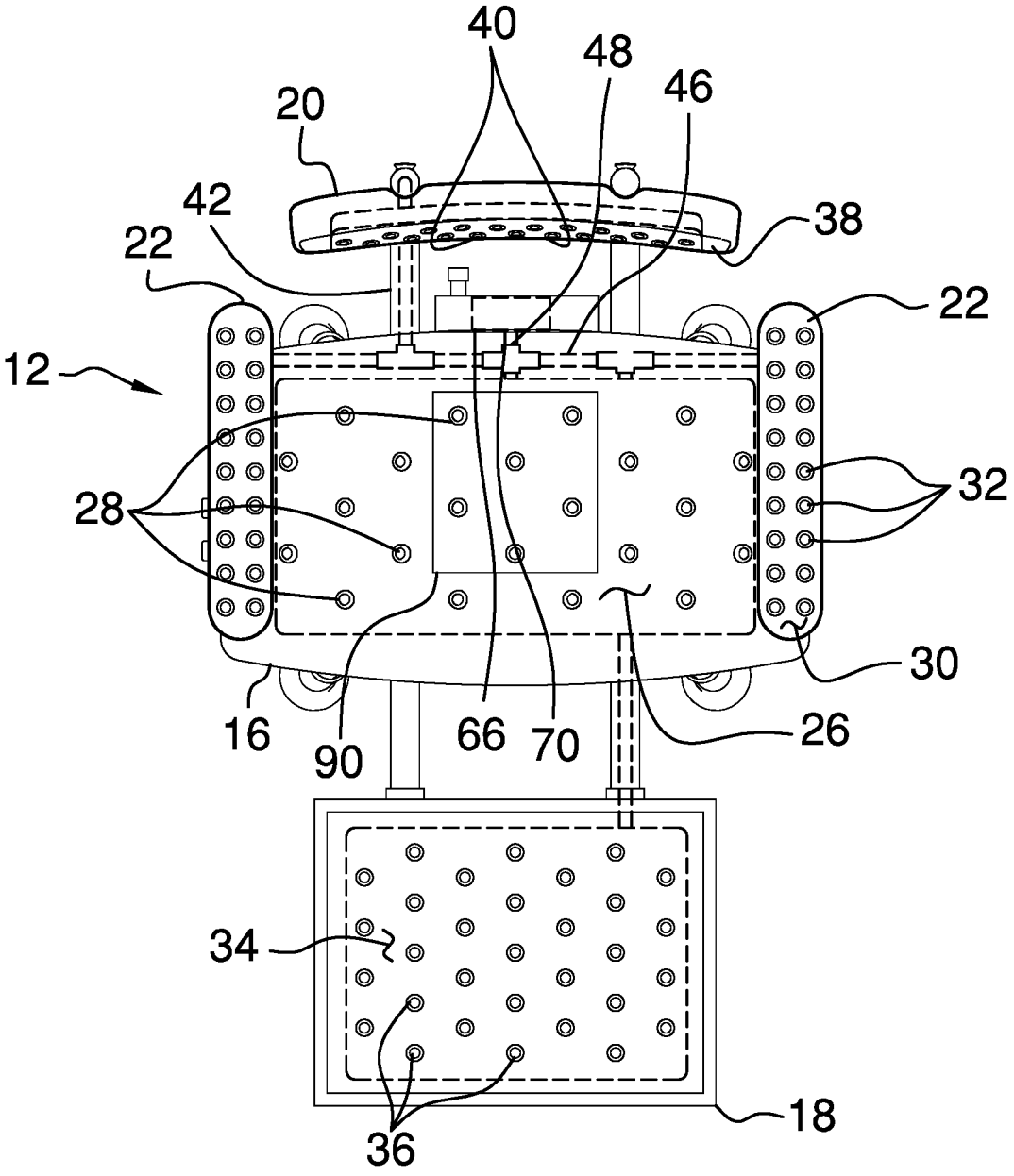
FIG. 3 is a top phantom view of an embodiment of the disclosure.
Figure 4:
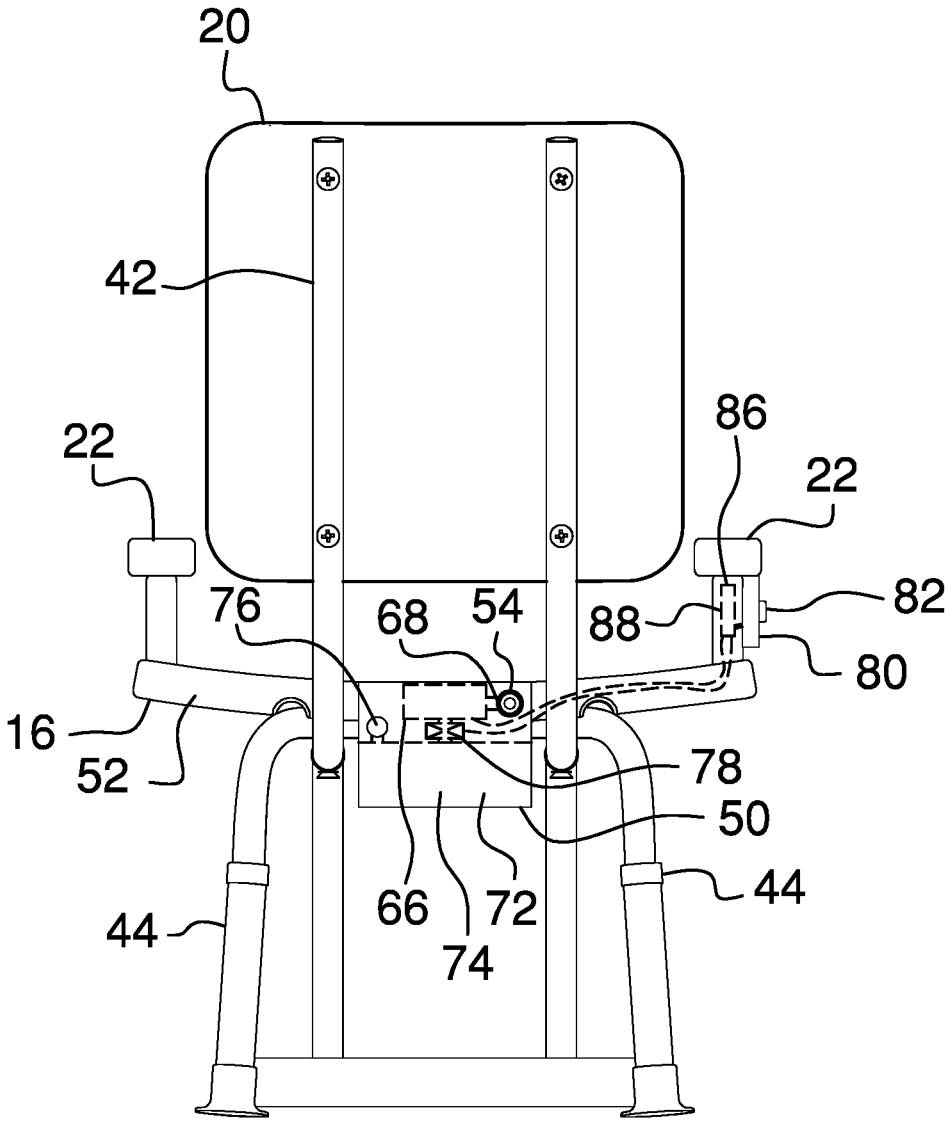
FIG. 4 is a back phantom view of an embodiment of the disclosure.
Figure 5:
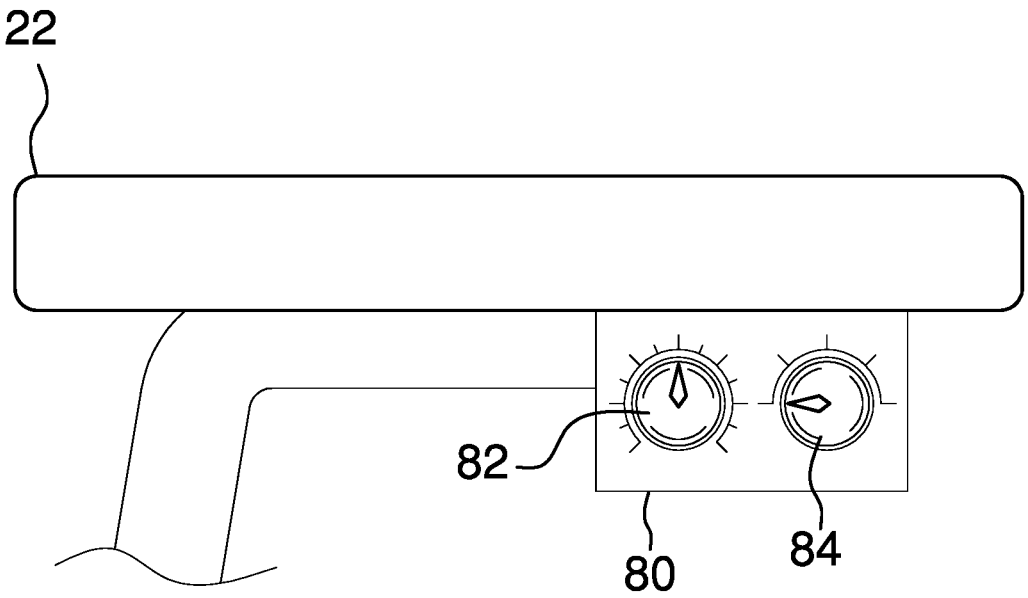
FIG. 5 is a detail view of a control panel of an embodiment of the disclosure.
Figure 6:
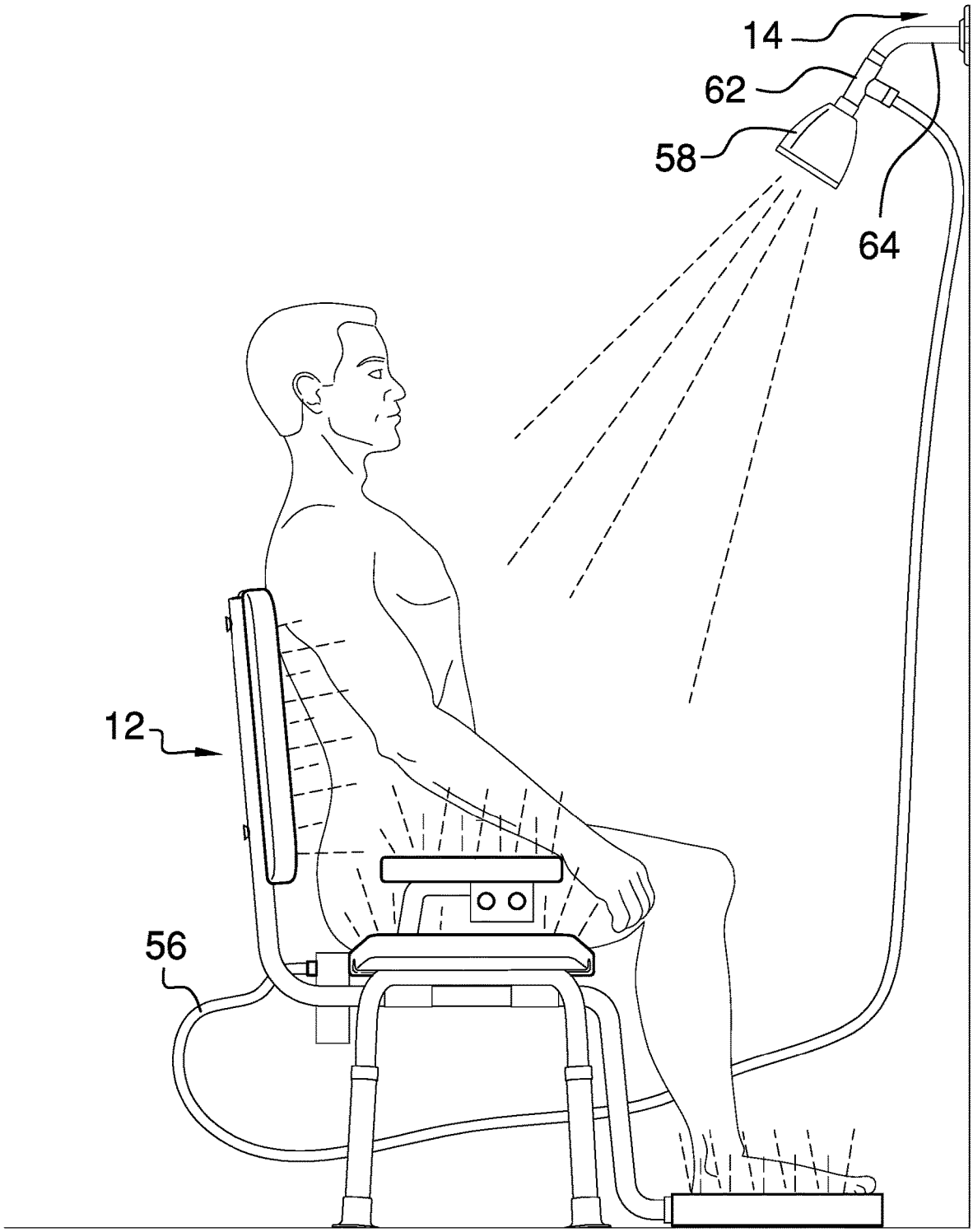
FIG. 6 is a perspective in-use view of an embodiment of the disclosure.

With reference now to the drawings, and in particular to FIGS. 1 through 6 thereof, a new bathing device embodying the principles and concepts of an embodiment of the disclosure and generally designated by the reference numeral 10 will be described.

As best illustrated in FIGS. 1 through 6, the bathing chair assembly 10 generally comprises a chair 12 that is positionable in a shower 14 for having a user being seated in the shower 14. The user may be an elderly user, a physically disabled user or any other user that may have trouble standing in the shower 14. The chair 12 has a seat 16, a foot rest 18, a back rest 20 and a pair of arm rests 22. Additionally, the seat 16, the foot rest 18, the back rest 20 and each of the arm rests 22 is foraminous to pass water 24 therethrough for bathing. The seat 16 is hollow, the foot rest 18 is hollow, the back rest 20 is hollow and each of the arm rests 22 is hollow.

The seat 16 has a top surface 26 and the top surface 26 has a plurality of water openings 28 each extending into an interior of the seat 16. Each of the arm rests 22 has a top surface 30 and the top surface 30 of each of the arm rests 22 has a plurality of water openings 32 extending into an interior of the arm rests 22. The foot rest 18 has a top surface 34 and the top surface 34 of the foot rest 18 has a plurality of water openings 36 extending into an interior of the foot rest 18. The back rest 20 has a front surface 38 and the front surface 38 has a plurality of water openings 40 extending into an interior of the back rest 20. Additionally, the chair 12 has a frame 42 and a plurality of legs 44.

An array of conduits 46 is provided and the array of conduits 46 is integrated into the chair 12. The array of conduits 46 is in fluid communication with the seat 16, the back rest 20, each of arm rests 22 and the foot rest 18. The array of conduits 46 extends throughout the frame 42 of the chair 12 for intersecting with each of the seat 16, the back rest 20, each of the arm rests 22 and the foot rest 18. Thus, the frame 42 protects the array of conduits 46 from damage. The array of conduits 46 has an input port 48.

A housing 50 is coupled to the chair 12 and the housing 50 is positioned on a back edge 52 of the seat 16 of the chair 12. The housing 50 has a fluid port 54 extending into an interior of the housing 50. The input port 48 of the array conduits 46 is in fluid communication with the fluid port 54. A hose 56 is fluidly coupled to the array of conduits 46 and the hose 56 is fluid attachable to a shower head 58 in the shower 14 for receiving water 24 therefrom. In this way the array of conduits 46 directs the water 24 outwardly through each of the back rest 20, the seat 16, each of the arm rests 22 and the foot rest 18 for bathing the user when the user is sitting in the chair 12.

The hose 56 is fluidly coupled to the fluid port 54 on the housing 50 and the hose 56 has a distal end 59 with respect to the housing 50. A fitting 60 is fluidly attached to the distal end 59. The fitting 60 has a through port 62 that is fluidly integrated into a fluid pipe 64 of the shower head 58 thereby facilitating the fitting 60 to direct water 24 to both the shower head 58 and the hose 56.

A pump 66 is positioned within the housing 50, and the pump 66 has an inlet 68 and an outlet 70. The inlet 68 is in fluid communication with the fluid port 54 on the housing 50 to receive the water 24. Additionally, the outlet 70 is in fluid communication with the input port 48 of the array of conduits 46. The pump 66 pumps the water 24 outwardly through the outlet 70 to increase the pressure of the water 24 that is sprayed outwardly from the chair 12. The pump 66 may comprise an electric fluid pump or the like that has a maximum pressure that is sufficiently low to avoid injuring the user.

A reservoir 72 is positioned within the housing 50 for containing a fluid soap 74. The fluid soap 74 may be a bathing soap that is safe for people to use. The reservoir 72 is in fluid communication with the array of conduits 46 for releasing the fluid soap 74 into the array of conduits 46. In this way the chair 12 can release a mixture of the fluid soap 74 and the water 24 for bathing. The reservoir 72 has a fill port 76 that extends outwardly through the housing 50. The reservoir 72 has an outlet 70 that is in fluid communication with the inlet 68 of the pump 66.

A valve 78 is positioned in the housing 50 and the valve 78 is fluidly coupled between the outlet 70 of the reservoir 72 and the inlet 68 of the pump 66. The valve 78 is actuatable between an open position and a closed position. The valve 78 inhibits the fluid soap 74 from exiting the reservoir 72 when the valve 78 is in the closed position. Conversely, the valve 78 facilitates the fluid soap 74 to exit the reservoir 72 when the valve 78 is in the open position. The valve 78 may comprise an electrically controlled fluid valve 78 or the like.

A control panel 80 is coupled to the chair 12 and the control panel 80 is suspended from a respective one of the arm rests 22. A pump control knob 82 is rotatably coupled to the control panel 80 and the pump control knob 82 is electrically coupled to the pump 66. The pump control knob 82 adjusts an operating pressure of the pump 66 between a minimum pressure and a maximum pressure. A soap control knob 84 is rotatably coupled to the control panel 80 and the soap control knob 84 is electrically coupled to the valve 78. The soap control knob 84 adjusts the valve 78 between the open position and the closed position.

A power supply 86 is positioned in the housing 50 and the power supply 86 is hermitically sealed within the housing 50. The power supply 86 is electrically coupled to the pump 66 and the valve 78, and the power supply 86 comprises at least one battery 88. As is most clearly shown in FIGS. 1 and 3, a door 90 may be integrated into the seat 16 and the door 90 can be opened to facilitate a caregiver to wash a disabled user's backside after defecation. As is most clearly shown in FIG. 2, a storage basket 92 may be attached to respective one of the arm rests 22 for storing bathing supplies 94.

In use, the chair 12 is placed in the shower 14 and the fitting 60 on the hose 56 is fluidly coupled to the shower head 58. Thus, water 24 sprays outwardly from the chair 12 when the shower 14 is turned on. In this way the user can bathe while the user is sitting in the chair 12. The pump control knob 82 is manipulated when the user wishes to increase the water 24 pressure being sprayed from the chair 12. Additionally, the soap control knob 84 is manipulated when the user wishes to mix soap with the water 24 that is being sprayed from the chair 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathing chair assembly being configured to spray water on a user for bathing while the user is seated, said assembly comprising:

a chair being positionable in a shower for having a user being seated in the shower, said chair having a seat, a foot rest, a back rest and a pair of arm rests, said seat, said foot rest, said back rest and each of said arm rests being foraminous wherein each of said seat, said foot rest, said back rest and said arm rests are configured to pass water therethrough for bathing;

an array of conduits, said array of conduits being integrated into said chair, said array of conduits being in fluid communication with said seat, said back rest, each of arm rests and said foot rest;

a hose being fluidly coupled to said array of conduits, said hose being fluid attachable to a shower head in the shower for receiving water therefrom wherein said array of conduits is configured to direct the water outwardly through each of said back rest, said seat, each of said arm rests and said foot rest for bathing the user when the user is sitting in said chair;

a pump being coupled to said chair, said pump being in fluid communication with said hose wherein said pump is configured to increase the pressure of the water being sprayed outwardly from said chair;

a reservoir being coupled to said chair wherein said reservoir is configured to contain a fluid soap, said reservoir being in fluid communication with said array of conduits for releasing the fluid soap into said array of conduits wherein said chair is configured to release a mixture of the fluid soap and the water for bathing; and wherein said seat is hollow, said foot rest being hollow, said back rest being hollow, each of said arm rests being hollow, said seat having a top surface, said top surface having a plurality of water openings each extending into an interior of said seat, each of said arm rests having a top surface, said top surface of each of said arm rests having a plurality of water openings extending into an interior of said arm rests, said foot rest having a top surface, said top surface of said foot rest having a plurality of water openings extending into an interior of said foot rest, said back rest having a front surface, said front surface having a plurality of water openings extending into an interior of said back rest, said chair having a frame and a plurality of legs.

2. The assembly according to claim 1, wherein said array of conduits extends throughout said frame of said chair for intersecting with each of said seat, said back rest, each of said arm rests and said foot rest, said array of conduits having an input port.

3. The assembly according to claim 2, further comprising a housing being coupled to said chair, said housing being positioned on a back edge of said seat of said chair, said housing having a fluid port extending into an interior of said housing, said input port of said array conduits being in fluid communication with said fluid port.

4. The assembly according to claim 3, wherein said hose is fluidly coupled to said fluid port on said housing, said hose having a distal end with respect to said housing, said distal end having a fitting being fluidly attached thereto, said fitting having a through port being fluidly integrated into a fluid pipe of the shower head thereby facilitating said fitting to direct water to both the shower head and said hose.

5. The assembly according to claim 4, wherein said pump has an inlet and an outlet, said inlet being in fluid communication with said fluid port on said housing wherein said pump is configured to receive the water, said outlet being in fluid communication with said input port of said array of conduits, said pump pumping the water outwardly through said outlet.

6. The assembly according to claim 5, wherein said reservoir having a till port extending outwardly through said housing, said reservoir having an outlet being in fluid communication with said inlet of said pump.

7. The assembly according to claim 6, further comprising a valve being positioned in said housing, said valve being fluidly coupled between said outlet of said reservoir and said inlet of said pump, said valve being actuatable between an open position and a closed position, said valve inhibiting the fluid soap from exiting said reservoir when said valve is in said closed position, said valve facilitating the fluid soap to exit said reservoir when said valve is in said open position.

8. The assembly according to claim 6, further comprising a control panel being coupled to said chair, said control panel being suspended from a respective one of said arm rests.

9. The assembly according to claim 8, further comprising a pump control knob being rotatably coupled to said control panel, said pump control knob being electrically coupled to said pump, said pump control knob adjusting an operating pressure of said pump between a minimum pressure and a maximum pressure.

10. The assembly according to claim 8, further comprising a soap control knob being rotatably coupled to said control panel, said soap control knob being electrically coupled to a valve being positioned in said reservoir, said soap control button adjusting said valve between said open position and said closed position.

11. The assembly according to claim 10, further comprising a power supply being positioned in said housing, said power supply being hermitically sealed within said housing, said power supply being electrically coupled to said pump and said valve, said power supply comprising at least one battery.

12. A bathing chair assembly being configured to spray water on a user for bathing while the user is seated, said assembly comprising:

a chair being positionable in a shower for having a user being seated in the shower, said chair having a seat, a foot rest, a back rest and a pair of arm rests, said seat, said foot rest, said back rest and each of said arm rests being foraminous wherein each of said seat, said foot rest, said back rest and said arm rests are configured to pass water therethrough for bathing, said seat being hollow, said foot rest being hollow, said back rest being hollow, each of said arm rests being hollow, said seat having a top surface, said top surface having a plurality of water openings each extending into an interior of said seat, each of said arm rests having a top surface, said top surface of each of said arm rests having a plurality of water openings extending into an interior of said arm rests, said foot rest having a top surface, said top surface of said foot rest having a plurality of water openings extending into an interior of said foot rest, said back rest having a front surface, said front surface having a plurality of water openings extending into an interior of said back rest, said chair having a frame and a plurality of legs;

an array of conduits, said array of conduits being integrated into said chair, said array of conduits being in fluid communication with said seat, said back rest, each of arm rests and said foot rest, said array of conduits extending throughout said frame of said chair for intersecting with each of said seat, said back rest, each of said arm rests and said foot rest, said array of conduits having an input port;

a housing being coupled to said chair, said housing being positioned on a back edge of said seat of said chair, said housing having a fluid port extending into an interior of said housing, said input port of said array conduits being in fluid communication with said fluid port;

a hose being fluidly coupled to said array of conduits, said hose being fluid attachable to a shower head in the shower for receiving water therefrom wherein said array of conduits is configured to direct the water outwardly through each of said back rest, said seat, each of said arm rests and said foot rest for bathing the user when the user is sitting in said chair, said hose being fluidly coupled to said fluid port on said housing, said hose having a distal end with respect to said housing, said distal end having a fitting being fluidly attached thereto, said fitting having a through port being fluidly integrated into a fluid pipe of the shower head thereby facilitating said fitting to direct water to both the shower head and said hose;

a pump being positioned within said housing, said pump having an inlet and an outlet, said inlet being in fluid communication with said fluid port on said housing wherein said pump is configured to receive the water, said outlet being in fluid communication with said input port of said array of conduits, said pump pumping the water outwardly through said outlet wherein said pump is configured to increase the pressure of the water being sprayed outwardly from said chair;

a reservoir being positioned within said housing wherein said reservoir is configured to contain a fluid soap, said reservoir being in fluid communication with said array of conduits for releasing the fluid soap into said array of conduits wherein said chair is configured to release a mixture of the fluid soap and the water for bathing, said reservoir having a fill port extending outwardly through said housing, said reservoir having an outlet being in fluid communication with said inlet of said pump;

a valve being positioned in said housing, said valve being fluidly coupled between said outlet of said reservoir and said inlet of said pump, said valve being actuatable between an open position and a closed position, said valve inhibiting the fluid soap from exiting said reservoir when said valve is in said closed position, said valve facilitating the fluid soap to exit said reservoir when said valve is in said open position;

a control panel being coupled to said chair, said control panel being suspended from a respective one of said arm rests;

a pump control knob being rotatably coupled to said control panel, said pump control knob being electrically coupled to said pump, said pump control knob adjusting an operating pressure of said pump between a minimum pressure and a maximum pressure;

a soap control knob being rotatably coupled to said control panel, said soap control knob being electrically coupled to said valve, said soap control button adjusting said valve between said open position and said closed position; and a power supply being positioned in said housing, said power supply being hermitically sealed within said housing, said power supply being electrically coupled to said pump and said valve, said power supply comprising at least one battery.

* * * * *